US006032450A

United States Patent [19]

Blum

[11] Patent Number: 6,032,450

[45] Date of Patent: Mar. 7, 2000

[54] METHOD FOR PRODUCING AN ELECTRICALLY CONDUCTIVE YARN, THE ELECTRICALLY CONDUCTIVE YARN AND USE OF THE ELECTRICALLY CONDUCTIVE YARN

[75] Inventor: Fritz Blum, Flums, Switzerland

[73] Assignee: Spoerry & Co. AG, Flums, Switzerland

[21] Appl. No.: 08/885,441

[22] Filed: Jun. 30, 1997

[30] Foreign Application Priority Data

Jul. 1, 1996 [CH] Switzerland ..... 19961638/96

[51] Int. Cl.[7] ..... D01H 7/56

[52] U.S. Cl. ..... 57/75; 57/66; 57/206; 57/209; 57/255; 57/256; 428/375; 442/228

[58] Field of Search ..... 57/75, 66, 206, 57/209, 255, 256; 428/375; 442/228

[56] References Cited

U.S. PATENT DOCUMENTS

| | | | |
|---|---|---|---|
| 3,639,807 | 2/1972 | McCune | 361/220 |
| 3,882,667 | 5/1975 | Barry | 57/362 |
| 3,987,613 | 10/1976 | Woods et al. | 57/256 |
| 4,154,881 | 5/1979 | Hirakawa et al. | 428/92 |
| 4,793,130 | 12/1988 | Togashi et al. | 57/210 |
| 5,160,775 | 11/1992 | Yamada | 428/95 |

FOREIGN PATENT DOCUMENTS

| | | |
|---|---|---|
| 0250260 | 11/1991 | European Pat. Off. . |
| 0644283 | 3/1995 | European Pat. Off. . |
| 21 20 418 | 11/1972 | Germany . |
| 42 00 421 | 7/1993 | Germany . |
| 2 018 323 | 10/1979 | United Kingdom . |
| 9324689 | 12/1993 | WIPO . |

*Primary Examiner*—Terrel Morris
*Assistant Examiner*—John J. Guarriello
*Attorney, Agent, or Firm*—Pauley Petersen Kinne & Fejer

[57] ABSTRACT

A method for producing an electrically conductive compound yarn. An electrically conductive monofilament metal thread is spun into a compound yarn together with textile fibers. A compound yarn of this type is particularly suitable for producing woven and knit materials.

16 Claims, 1 Drawing Sheet

METHOD FOR PRODUCING AN ELECTRICALLY CONDUCTIVE YARN, THE ELECTRICALLY CONDUCTIVE YARN AND USE OF THE ELECTRICALLY CONDUCTIVE YARN

BACKGROUND OF THE INVENTION

1. Field of the Invention

This invention relates to a method for producing an electrically conductive compound yarn from an electrically conductive metallic portion and a textile portion. This invention also relates to the electrically conductive yarn itself produced in accordance with the method, and to its use.

2. Description of Prior Art

Some attempts for producing electrically conductive textile materials have been attempted. Woven goods with metal threads inserted are known. So that the weaving of metal threads causes fewer problems at the loom, it was attempted to process the metal threads into a mixed yarn or a compound yarn.

For example, a production method for such a compound yarn is known from PCT International Application WO 93/24689. This is a compound yarn made of textile fibers of the same or different types, which are twisted with a metal wire of annealed, silvered or gilded copper or of annealed stainless steel, with a diameter between 0.008 and 0.05 mm. After twisting the compound yarn, the metal wire essentially is located in an axial longitudinal direction between mutual contact zones of the individual textile fibers.

In this case the metal wire remains somewhat stretched inside the compound yarn. The bond between the partial yarn and the wire is not always sufficient and there is a danger that the compound yarn becomes separated again in the course of further processing.

Another comparable method is described in European Patent Reference EP-A-0 644 283. Here, metallic wires and textile threads when brought together are twisted with each other. An advantage of this compound yarn is that the bond between the textile threads and the metal wires is very good. However, there is a disadvantage that the metal wires are already considerably mechanically prestressed and the compound yarn is relatively stiff and prone to break.

The use of a metal-containing compound yarn for screening is known from European Patent Reference EP-A-0 250 260, wherein the compound yarn has a core and a sheath. The compound yarn comprises metallic and non-metallic fibers, wherein the core essentially contains a continuous metallic filament, reinforced by a non-metallic filament or yarn, and the sheath contains a non-metallic filament or yarns, which are wound around the core and constitute at least 70% of the surface of the compound yarn, wherein the non-metallic fibers are made of chemical or synthetic fibers. Here, too, the compound yarn is created by twisting and has the associated advantages and disadvantages.

A method for the production of a compound yarn, which actually could be identified as a mixed yarn, is taught by U.S. Pat. No. 3,987,613, which in contrast to previously described compound yarns is not created by twisting. Short copper fibers of a diameter of 0.025 mm and a length of approximately 40 mm are mixed with textile fibers prior to producing the yarn and are subsequently spun into a yarn together. The spun mixed yarn contains between 0.25 and 15 weight-percent of metallic fibers. So that such a spun mixed yarn could become electrically conductive, the mixed yarn should contain a considerably higher percentage of metal fibers which have sufficient contact with each other in the yarn itself. These metal fibers are naturally distributed over the entire yarn cross section. Since they are also present at the yarn surface, they cause considerable wear of the respective processing devices and machines during spinning and during any further processing, which is problematic.

SUMMARY OF THE INVENTION

It is one object of this invention to create a compound yarn with an electrically conductive portion and a textile portion, preferably cotton, which has no previously mentioned disadvantages, which assures a good bond between the electrically conductive materials and the fibers, and which can be further processed into flat textile shapes, such as woven and knit materials. In this connection it is particularly important that the electrically conductive portion causes little damage to and wear of the machines during processing and further treatment and is as little as possible mechanically prestressed.

A further object of this invention is to provide the yarn itself and a special use of the yarn for flat textile shapes for screening, deflection and prevention of electrical fields and their effects.

The above and other objects of this invention are accomplished with this invention as discussed in the specification and recited in the claims.

BRIEF DESCRIPTION OF THE DRAWINGS

This invention will be described below in connection with the drawings wherein.

DESCRIPTION OF PREFERRED EMBODIMENTS

Figure 1:
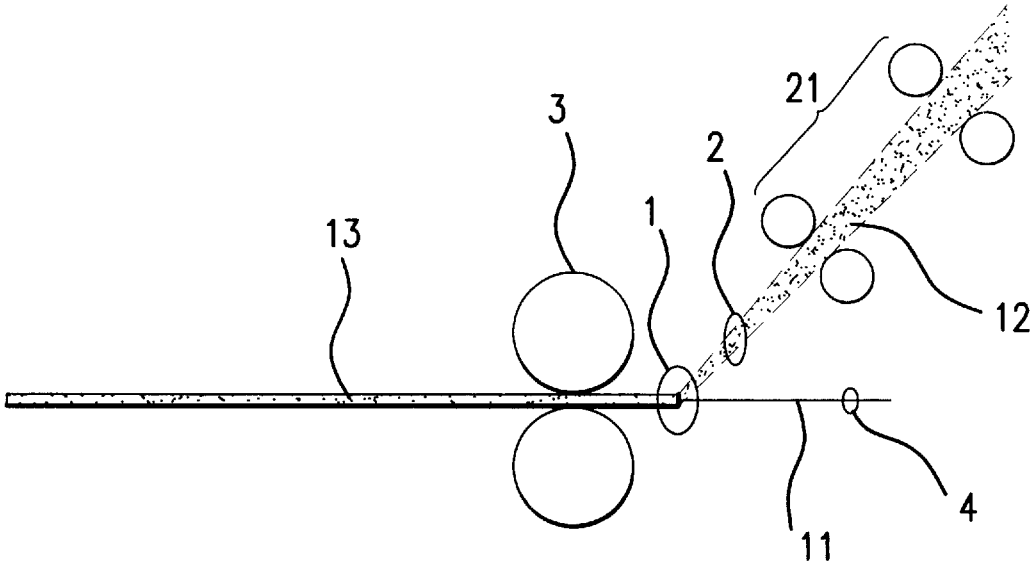
FIG. 1 is a schematic representation of the method in accordance with one preferred embodiment of this invention.

There are known special problems associated with the production of a compound of textiles and metals. A metal wire or metal thread usually has a smooth surface but textile fibers are relatively rough. For this reason, such conventional compound yarns are twisted, which results in a particular type of mechanical bonding between the metallic portion and the textile portion. With the method in accordance with this invention, a basically endless, electrically conductive monofilament metal thread is directly spun together with textile fibers in one operational step, which results in a completely different type of a bond between the metallic portion and the textile portion and results in a yarn with considerably different properties. On the one hand, the electrically conductive monofilament metal thread is supplied, centered to a ring spinning machine. Simultaneously, the portion of textile fibers is supplied laterally with respect to the metal thread in the form of roving or stubbing. The metal thread and the stubbing are then spun together into a compound yarn in the ring spinning machine. Therefore the metal thread always remains approximately centered in the middle of the yarn. In this connection, it is extraordinarily important that during the spinning process the metal thread is maintained under approximately constant minimal tension, or at least under approximately no tension. To this end the ring spinning machine has necessary tensile force sensors and servo drives and brakes, and the ring/traveller combination should be accordingly matched to the combination of materials, the surfaces of these materials and the spinning speed. It is thus possible for the monofilament metal thread to be barely twisted even during the spinning process. The metal thread should remain without rotation as much as possible, so that the metal thread is mechanically prestressed as little as possible prior to further processing, such as winding, weaving, knitting, etc. Therefore the compound yarn spun in this way has an approximately non-rotated metallic endless core.

All natural or synthetic fibers can basically be used as the textile fibers. However, some fibers assure a bond of lesser quality with the metal thread. Cotton fibers, for example, are very well suited for such a compound yarn. Alloys containing a thread of copper and/or of silver are preferably used as the electrically conductive monofilament thread. However, certain alloys of steel or light metals are also possible. The metal thread has a diameter of approximately 10 to 30 $\mu$m. Up to now very good results have been achieved with a metal thread diameter of 20 to 25 $\mu$m.

Special attention should be paid during spinning to the uneven weight proportion of the metallic portion and the textile portion of the yarn. The metal thread of such a yarn only needs to provide electrical conductivity and does not have any bearing function and should be as flexible, bendable and light as possible. For further processing, the flexibility must correspond at least approximately to that of normal yarn, so that the spun thread can also be woven or knit. For this reason the metal thread is made as thin and light as at all possible, which places completely different demands on the spinning process, in particular on the feeding of the metal thread and the tensile force control.

In accordance with one preferred embodiment of this invention, the metal thread is fed to the spinning station along a straightest possible and a shortest possible path. The metal thread is fed to the spinning station at least approximately without prestress and with the smallest possible twisting. The metal thread is drawn off a bobbin either tangentially, or in the conventional way with a small balloon of thread. With tangential draw-off from the bobbin, the metal thread is advantageously conducted in a straight line from the bobbin to the spinning station and during unwinding the bobbin is moved laterally back and forth, corresponding to the winding. An even better way is the draw-off from the interior of a coreless bobbin. Since the draw-off takes place without prestress if possible, a yarn brake can be omitted from the method.

So that the quality of the bond between the monofilament metal thread and the cotton fibers has the quality required for further processing, the stubbing should be well and homogeneously prestressed, and the cotton fibers should have a fiber length which is as uniform as possible.

The bond between the metal thread and the textile fibers is additionally improved by coating the metal thread. Normally, coating is done with a lacquer. On the one hand, the lacquer counteracts the brittleness of the metal thread and at the same time increases surface adhesion and thus the quality of the bond between the metal thread and the textile fibers. This also solves the problems associated with the danger of catalytic damage in the compound yarn itself and to the machine elements which is caused by the compound yarn. In addition, coating the metal threads helps prevent oxidation and catalytic damage or to at least reduce the associated danger.

The compound can additionally be briefly heated in an area downstream of the spinning station. While coating, the metal thread is softened temporarily which makes the contact and the adhesion between the latter and the textile fibers more intimate. The surface of the coating can adapt in shape somewhat to the textile fibers and a sort of interlocking is thus achieved. The heated lacquer of the coating also becomes slightly sticky, which further improves the bond.

The production of a compound yarn with an electrically conductive metallic and a textile portion is schematically represented in FIG. 1. An electrically conductive monofilament metal thread 11 is fed on as straight and short a path as possible to the actual spinning station 1 of a ring spinning machine. Simultaneously, a stubbing of textile fibers 12, which have been stretched several times by means of stretching devices 21, is also fed by means of a feed device 2 to the spinning station 1. The metal thread 11 is directly fed under almost no tensile force to the spinning station 1. This can be monitored and, if required, corrected by a feed device 4 with appropriate tensile force sensors and servo units. The textile fibers of the stubbing 12 are now spun together in the ring spinning machine with a core comprising a coated metal thread 11 to form a compound yarn 13. A draw-off device 3 removes the compound yarn 13 and simultaneously controls the tensile force on the compound yarn 13 with its core made of the monofilament metal thread 11. It is important that the tensile force during draw-off remains low, namely until and during the subsequent winding, so that the metal thread 11 is as little as possible mechanically stressed.

Figure 2:
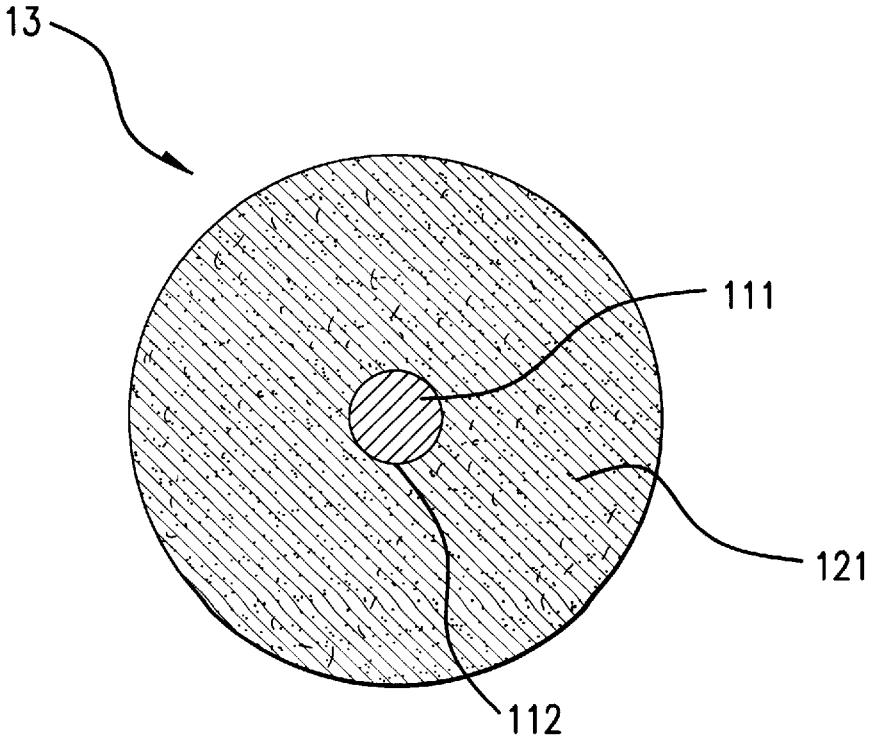
FIG. 2 is a cross section taken through a compound yarn created in accordance with a method according to one preferred embodiment of this invention.

A cross section through a spun compound yarn is represented in FIG. 2. The compound yarn comprises core 111 of the metal thread 11, which has a thin coating 112 all around the core 111. The textile portion of the spun compound yarn 13 is located around the metal thread 11.

An electrically conductive compound yarn produced in accordance with this method can be further processed. It is particularly suitable for producing woven materials of nearly any arbitrary type. It can also be further processed into knit goods. It is preferably used in the form of a woven material or of knit goods in places, where electrostatic or electrodynamic fields must be shielded or even deflected. For example, it can be used for constructing Faraday cages or shielded and grounded surfaces or rooms. To this end it is possible, for example, to work a thin woven or knit material made of such a yarn, or even only individual strands of compound yarn, into wallpaper. In the same way it is possible to produce a textile or paper wallpaper made of such woven or knit material, because it can even be dyed or printed. A further use is for introducing or applying such yams, woven or knit materials into or to heat-insulating or sound-insulating panels. These wallpapers or insulating panels can therefore also be connected to ground wires and thereby expand the area of use.

I claim:

1. In a method for producing an electrically conductive compound yarn (13) from an electrically conductive metallic portion and a textile portion, the improvement comprising:

laterally feeding the textile portion in a form of a plurality of slubbings (12) and simultaneously centrally feeding an endless electrically conductive monofilament metal thread (11) directly to a centered location of a spinning station (1) of a ring spinning machine;

feeding the monofilament metal thread (11) nearly free of tensile force together with the slubbings (12) to the spinning station (1) after repeatedly stretching the slubbings (12) into a single compound yarn wherein the monofilament metal thread (11) is approximately centered within the single compound yarn; and subsequently passing on the electrically conductive compound yarn (13) for further processing with a draw-off device.

2. In the method in accordance with claim 1, wherein the monofilament metal thread (11) is pulled off a bobbin at least approximately without rotation of the monofilament metal thread (11) and is fed to the spinning station (1).

3. In the method in accordance with claim 2, wherein the monofilament metal thread (11) is pulled off tangentially from the bobbin.

4. In the method in accordance with claim 3, wherein the monofilament metal thread (11) pulled tangentially off the bobbin is fed to the spinning station (1) in a straight line and the bobbin is moved laterally back and forth during unwinding of the bobbin.

5. In the method in accordance with claim 2, wherein the monofilament metal thread (11) is pulled out of an interior of a coreless bobbin.

6. In the method in accordance with claim 1, wherein the compound yarn (13) is briefly heated in an area downstream of the spinning station (1) and a coating (112) of the monofilament metal thread (11) is softened.

7. In the method in accordance with claim 1, wherein the monofilament metal thread (11) comprises a coated copper wire (11, 112).

8. In the method in accordance with claim 7 wherein the monofilament metal thread (11) comprises silver.

9. In the method in accordance with claim 7 wherein the monofilament metal thread (11) has a diameter of at least 10 $\mu$m and at most 50 $\mu$m.

10. In the method in accordance with claim 7 wherein the slubbings (12) comprise cotton.

11. In the method in accordance with claim 7 wherein the compound yarn is made into a woven material.

12. In the method in accordance with claim 11 wherein the woven material is incorporated into wallpaper.

13. In the method in accordance with claim 11 wherein the woven material is incorporated into an insulation panel of one of foam plastic and mineral fibers.

14. In the method in accordance with claim 7 wherein the compound yam is made into a knit material.

15. In the method in accordance with claim 14 wherein the knit material is incorporated into wallpaper.

16. In the method in accordance with claim 14 wherein the knit material is incorporated into an insulation panel of one of foam plastic and mineral fibers.

* * * * *